US005226666A

United States Patent [19]

Dinkens, Jr.

[11] Patent Number: 5,226,666

[45] Date of Patent: Jul. 13, 1993

[54] GOLF CLUB RACK

[76] Inventor: Lucian B. Dinkens, Jr., 6300 S. 60 Hwy., Lot 68, Apache Junction, Ariz. 85219

[21] Appl. No.: 835,841

[22] Filed: Feb. 18, 1992

[51] Int. Cl.[5] ..... B62B 5/00

[52] U.S. Cl. ..... 280/652; 211/70.2; 224/274

[58] Field of Search ..... 248/96; 211/70.2; 206/315.2, 315.5; 224/274, 277; 280/DIG. 6, 47.315, 47.33, 655.1, 652

[56] References Cited

U.S. PATENT DOCUMENTS

| | | | |
|---|---|---|---|
| D. 164,503 | 9/1951 | Kerr | 211/70.2 X |
| 1,231,030 | 3/1916 | Cady | 280/47.33 |
| 1,289,830 | 12/1918 | Leimecke | 248/293 |
| 1,581,061 | 4/1926 | Johnston | 206/315.2 X |
| 2,415,314 | 2/1947 | Todd | 211/70.2 |
| 2,520,226 | 8/1950 | Smith | 206/315.5 X |
| 2,523,590 | 9/1950 | Potter et al. | 224/274 |
| 2,570,504 | 10/1951 | Van House | 280/DIG. 6 X |
| 2,737,990 | 3/1956 | DeMarco | 150/1.5 |
| 2,941,814 | 6/1960 | Mihalyi | 280/DIG. 6 X |
| 2,957,700 | 10/1960 | Beaurline | 211/70.2 X |
| 2,990,865 | 7/1961 | Steele | 150/1.5 |
| 3,058,504 | 10/1962 | Powers | 150/1.5 |
| 3,215,181 | 11/1965 | Reed | 150/1.5 |
| 3,415,572 | 12/1968 | Zagwyn | 211/70.2 X |
| 4,017,091 | 4/1977 | Wallen | 280/DIG. 6 |
| 4,036,416 | 7/1977 | Lowe . | |
| 4,074,739 | 2/1978 | Rodeghier | 150/1.5 |
| 4,230,247 | 10/1980 | Lowe | 294/143 |
| 4,618,157 | 10/1986 | Resnick | 280/47.315 X |
| 4,629,202 | 12/1986 | Nelson et al. | 280/DIG. 6 X |
| 4,666,038 | 5/1987 | Minneman | 206/315.2 |

*Primary Examiner*—Blair M. Johnson
*Assistant Examiner*—Korie H. Chan
*Attorney, Agent, or Firm*—Don J. Flickinger; Jordan M. Meschkow; Robert A. Parsons

[57] ABSTRACT

A golf club carrier including an inverted U-shaped frame having a pair of spaced apart legs extending from a common cross member. A brace extends between the legs proximate the lower ends thereof. A tripod leg, secured to the cross member, is moveable between a retracted position and an extended position. A plurality of club clips, arranged in pairs, are carried by the legs for the purpose of holding the golf clubs.

5 Claims, 3 Drawing Sheets

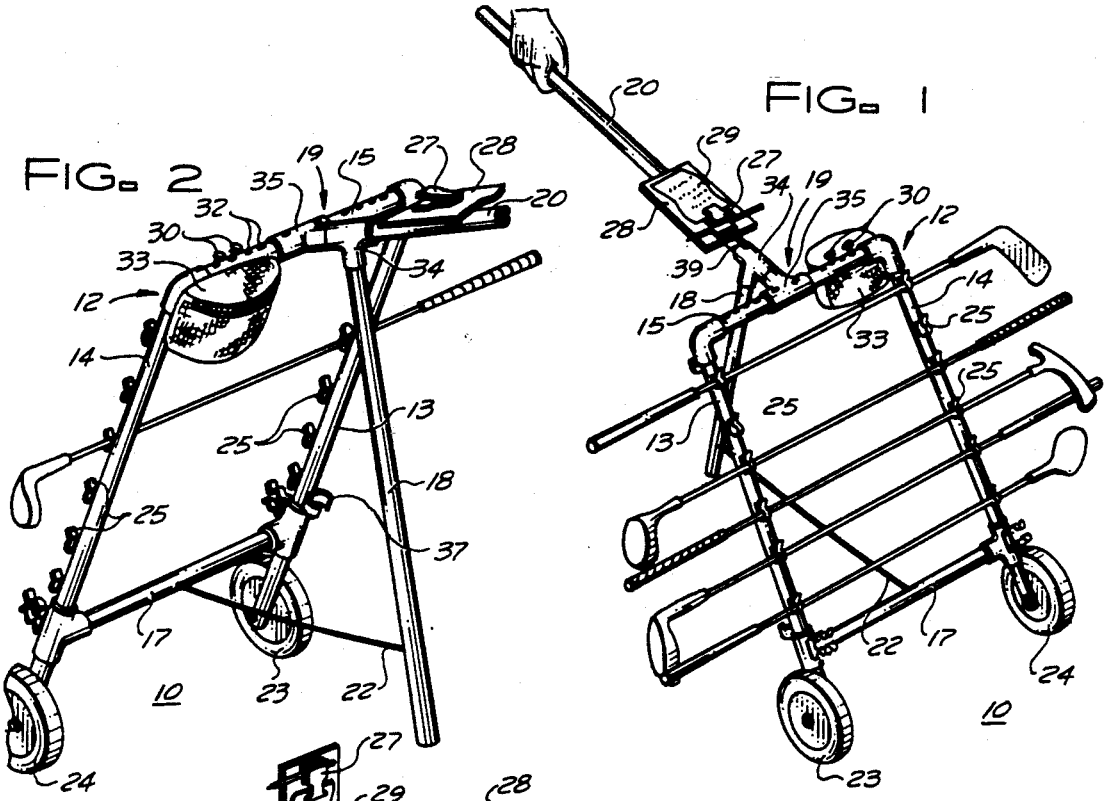
FIG. 1
FIG. 2
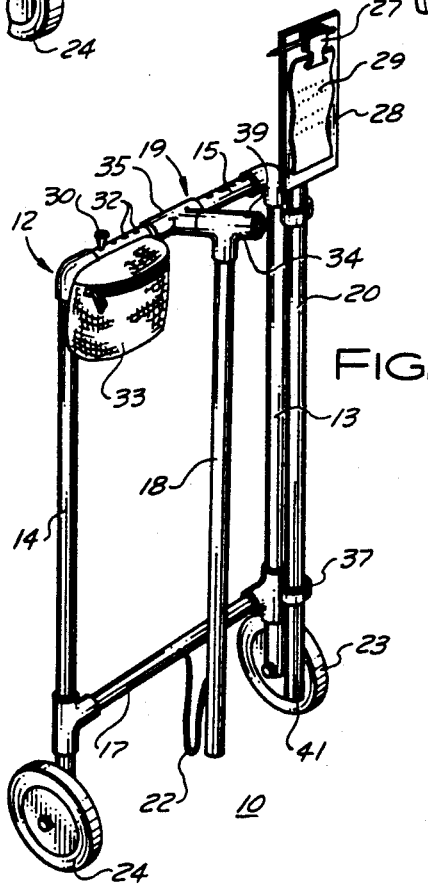
FIG. 3
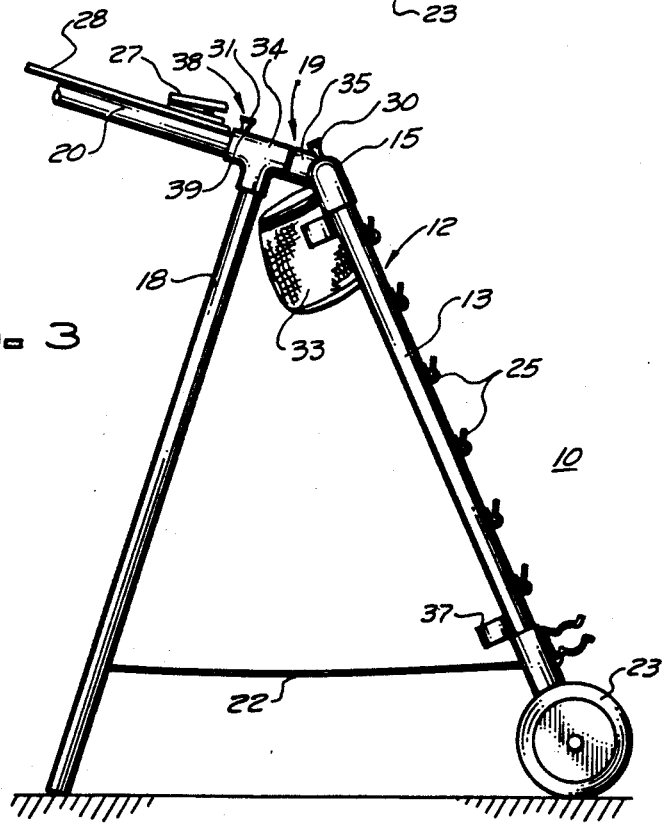
FIG. 4

GOLF CLUB RACK

BACKGROUND OF THE INVENTION

1. Field of the Invention

This invention relates to a device for holding golf clubs.

More particularly, the present invention relates to a portable device for holding and transporting golf equipment.

2. Prior Art

Devices for carrying golf equipment, specifically golf clubs, are well-known. The popularity of golf is increasing along with the number of golfers. As the number of golfers increase, the type and age of golfers also become more varied.

Traditionally, golfers golfed on full courses which required a large variety of different clubs. Each club is used to hit a golf ball a different distance. Generally, these clubs were carried in a golf bag adapted to be slung over the shoulder. Golf bags are usually cumbersome, heavy, and expensive because of the amount and kinds of material required in their fabrication. Sometimes a caddy can be hired to carry the club bag, but are often unavailable or expensive.

With the increase in the number of different types of golfers, a greater variety of golf courses are also being provided. Many golfers, because of time constraints or physical considerations such as age, prefer short courses. These courses require less time, less walking and do not require the same number of clubs as a full course does. Under these conditions, the conventional golf bag is considered an undo encumbrance and burden.

It would be highly advantageous, therefore, to remedy the foregoing and other deficiencies inherent in the prior art.

Accordingly, it is an object of the present invention to provide an improved golf club carrier.

Another object of the present invention is to provide a golf club carrier which is light and easily moved.

And another object of the present invention is to provide a golf club carrier which holds golf clubs so they are easily identifiable and removable.

Still another object of the present invention is to provide a golf club carrier which will stand vertically on substantially any surface.

Yet another object of the present invention is to provide a golf club rack which is relatively inexpensive.

A further object of the present invention is to provide a golf club carrier which can also carry golf balls and golf tees.

SUMMARY OF THE INVENTION

Briefly, to achieve the desired objects of the instant invention in accordance with the preferred embodiment thereof, provided is an inverted U-shaped frame, having legs and a cross member. A brace extends between the legs proximate their lower ends. A tripod leg is pivotally secured to the cross member. In the retracted position, the tripod leg resides against the brace. Movement of the tripod leg in the extended position is limited by a limiting member. A plurality of clips are carried by the legs. The clips are arranged in aligned pairs, one being carried by each of the legs for the purpose of holding golf clubs.

BRIEF DESCRIPTION OF THE DRAWINGS

The foregoing and further and more specific objects and advantages of the instant invention will become readily apparent to those skilled in the art from the following detailed description of the preferred embodiment thereof taken in conjunction with the drawings in which:

FIG. 1 is a perspective view of a golf club carrier, constructed in accordance with the teachings of the instant invention, as it would appear holding golf clubs and being pulled by hand;

FIG. 2 is a perspective view of the device shown in FIG. 1 as it would appear in its vertical set-up position;

FIG. 3 is a perspective view of the device shown in FIG. 1 as it in its storage position;

FIG. 4 is a side view of the device shown in FIG. 2;

DESCRIPTION OF THE PREFERRED EMBODIMENT

Figure 5:
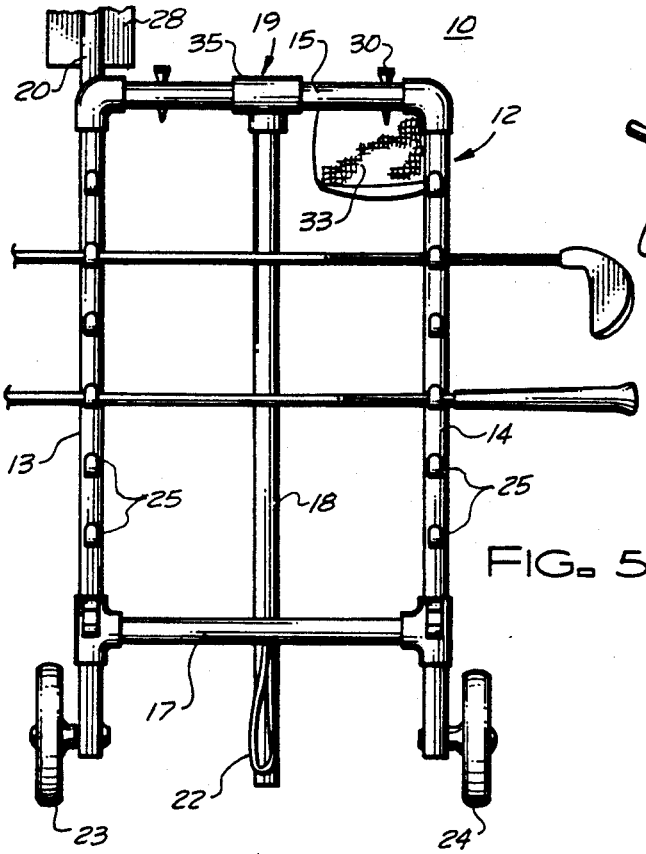
FIG. 5 is a front view of the golf club carrier illustrated FIG. 2.

Turning now to the drawings in which like reference characters indicate corresponding elements throughout the several views, attention is first directed to FIG. 1 which illustrates a golf club carrier generally designated 10 in its mobile configuration. Golf club carrier 10 consists of an inverted U-shaped frame 12 having a first leg 13 and a second leg 14 coupled at their upper ends by a cross member 15. A brace 17 extends between legs 13 and 14 proximate the lower ends thereof. A tripod leg 18 is coupled to cross member 15 by a hinge means 19. Tripod leg 18 pivots on hinge means 19 to allow golf club carrier 10 to sit in a vertical upright position when extended. A handle 20 is coupled to cross member 15 at hinge means 19, in this preferred embodiment, allowing the golf club carrier 10 to be moved by the handle and tripod leg 18 to be extended by using handle 20. A limiting member 22, in this embodiment consisting of a cord, is coupled to brace 17 and the lower end of tripod leg 18. Limiting member 22 prevents tripod leg 18 from being extended past a secure point for supporting golf club carrier 10.

Still referring to FIG. 1, golf club carrier 10, in this preferred embodiment, includes a wheel 23 and a wheel 24 coupled to the lower ends of legs 13 and 14 respectively, below brace 17. Wheels 23 and 24 permit golf club carrier 10 to be moved from location to location with a minimum of effort. Included in the preferred embodiment is a number of golf club clips 25 coupled to legs 13 and 14. Golf club clips 25 are arranged in aligned pairs, one being carried by each of the legs for the purpose of holding golf clubs. A board 28 is also attached to handle 20 near its junction with hinge means 19. A score card clip 27 is coupled to board 28 to permit a scorecard 29 to be attached thereto. Scorecard clip 27 holds scorecard 29 on board 28 to permit a golfer to write conveniently thereon. A plurality of tee openings 32, formed in cross member 15, receive and hold golf tees 30. A pouch 33 is coupled to cross member 15 to hold golf balls and other paraphernalia.

Referring now to FIG. 4, it can be seen that hinge means 19 in this embodiment, consists of a tee-shaped member 34 having a coupling means 38 coupling handle 20 perpendicularly to tripod leg 18. In this embodiment, coupling means 38 consists of a hole 39 formed in tee-shaped member 34, and a hole 41 formed in handle 20. Handle 20 is secured in place by inserting handle 20 into tee-shaped member 34 and aligning holes 39 and 41. A pin 31 is inserted through holes 39 and 41 securing handle 20 in place. In this embodiment, pin 31 is a golf tee. A pivotal tee-shaped member 35 is pivotally coupled to cross member 15 such that cross member 15 extends from opposing sides of pivotal tee-shaped member 35. Tee-shaped member 34 is coupled to pivotal tee-shaped member 35 such that handle 20 extends perpendicularly from pivotal tee-shaped member 35 with respect to cross member 15. It will be understood by those skilled in the art that while hinge means 19 in this preferred embodiment consists of a pivotal tee-shaped member 35, other hinge means 19 may be used, as discussed further below.

Referring now to FIGS. 2 and 3, golf club carrier 10 is illustrated in its vertical set-up or transport position and its storage position respectively. In FIG. 2, handle 20 is coupled to tee-shaped member 34. Pivotal tee-shaped member 35 is pivoted so as to extend tripod leg 18 to the limit of limiting member 22. This forms a stable tripod which can be left standing substantially anywhere allowing for easy access to clubs and accessories. In FIG. 3, handle 20 is removed from tee-shaped member 34 and secured to first leg 13 by handle clips 37. FIG. 3 also illustrates pivotal tee-shaped member 35 pivoted so as to retract tripod leg 18 until it resides against brace 17 substantially parallel to legs 13 and 14. This configuration allows club carrier 10 to be easily stored.

Figure 6:
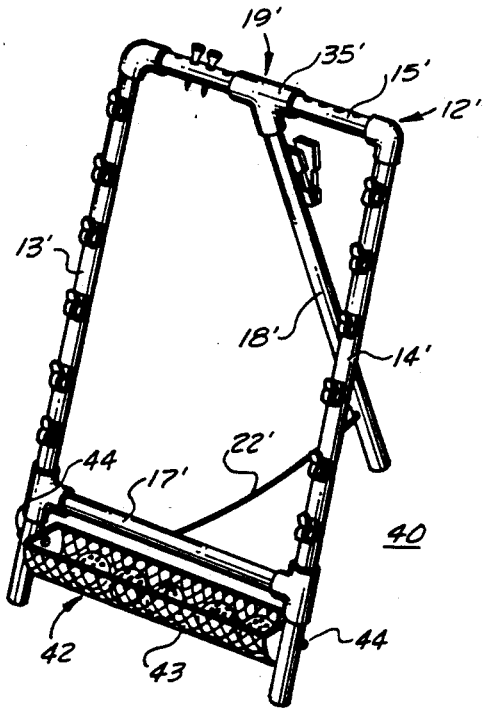
FIG. 6 is a perspective view of an alternate embodiment of the present invention shown in a vertical set-up position.

FIG. 6 is another embodiment 40 of a golf club carrier, with parts similar to golf club carrier 10 shown in FIGS. 1 through 5 being designated with similar numbers and all numbers having a ' added to indicate it as a different embodiment. Embodiment 40 consists of a generally U-shaped frame 12' having first and second legs 13' and 14' respectively. Legs 13' and 14' are coupled at their upper ends by a cross member 15', and proximate their lower ends by a brace 17'. Hinge means 19' is a pivotal tee-shaped member 35, coupled to cross member 15'. A tripod leg 18' is coupled directly to pivotal tee-shaped member 35, which permits extension and retraction of tripod leg 18'. The extension of tripod leg 18' is limited by limiting member 22'. Embodiment 40 differs from golf club carrier 10 in that, there is no tee-shaped member 14 and no handle 20, tripod leg 18' couples directly to pivotal tee-shaped member 35'. Also, embodiment 40 does not have wheels 23, but can be set directly on the ground and when in its extended position supported by legs 13' and 14' and tripod leg 18'.

Figure 7:
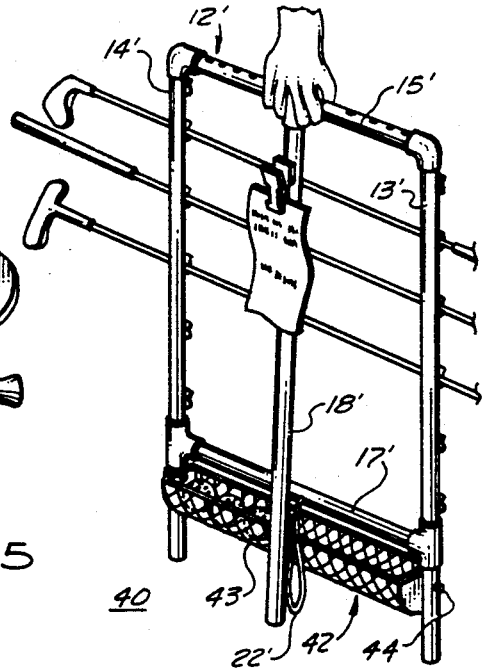
FIG. 7 is a perspective view illustrating the device shown in FIG. 6 as it would appear being carried.

Referring now to FIG. 7, embodiment 40 is illustrated in its transportable position. In this position, tripod leg 18' is retracted so that it is substantially parallel to legs 13' and 14' and rests against brace 17'. Embodiment 40 is then transported by grasping hinge means 19 on cross member 15'. Also, embodiment 40 has scorecard clip 27' and board 28' coupled to tripod leg 18' proximate hinge means 19'. After embodiment 40 has been transported to the desired location, it can then be set-up by extending tripod leg 18' as illustrated in FIG. 6.

Figure 8:
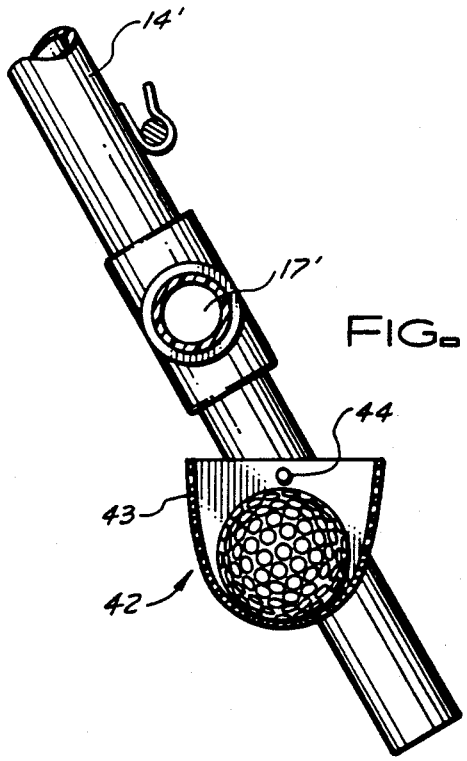
FIG. 8 is an enlarged side view of the ball carrier of the embodiment shown in FIG. 6.

Still referring to FIG. 7, embodiment 40 includes a golf ball holder 42, pivotally coupled between legs 13' and 14' below and parallel to brace 17'. Golf ball holder 42 is a trough-shaped basket 43 coupled at each end to legs 13' and 14'. A pin 44 extends from each of legs 13 and 14 respectively and extends into the ends of basket 43 as illustrated in FIG. 8. Pin 44 coupling basket 43 to legs 13' and 14' allows ball holder 42 to pivot freely. The weight of golf balls always hold golf ball holder 42 in such a way that the tilt of U-shaped frame 12' will not spill balls from ball holder 42.

Figure 9:
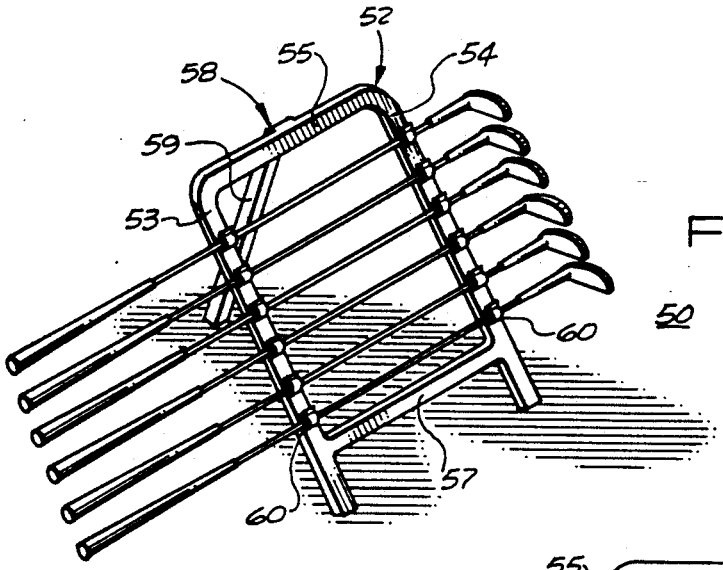
FIG. 9 is a perspective view of another embodiment of the golf club/carrier as it would appear in its vertical set-up position.

Referring now to FIG. 9, a further embodiment 50 of a golf club carrier is illustrated. Embodiment 50 consists of a generally U-shaped frame 52 having a first leg 53 and a second leg 54 joined by a cross member 55. A brace 57 is coupled between legs 53 and 54 proximate their lower end. A tripod leg 59 is pivotally coupled to cross member 55 by a hinge means 58. A plurality of club clips 60 are coupled to legs 53 and 54. Club clips 60 are arranged in aligned pairs, one being carried by each of legs 13 and 14.

Figure 10:
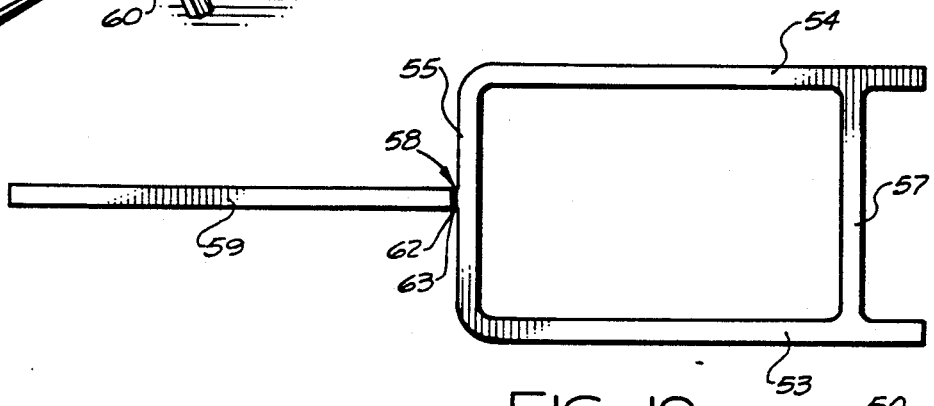
FIG. 10 is a top view of the frame of the third embodiment illustrated in FIG. 9.
Figure 11:
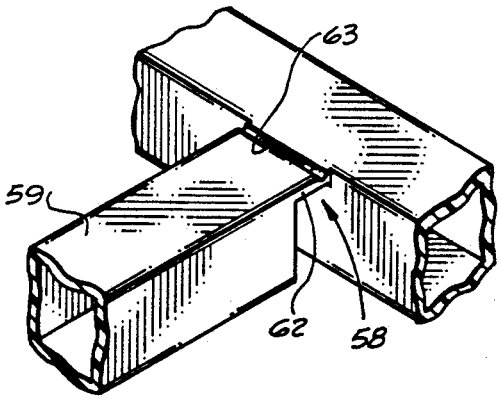
FIG. 11 is an enlarged view of the hinge coupling the pivotal leg to the cross piece of the third embodiment of the present invention.
Figure 12:
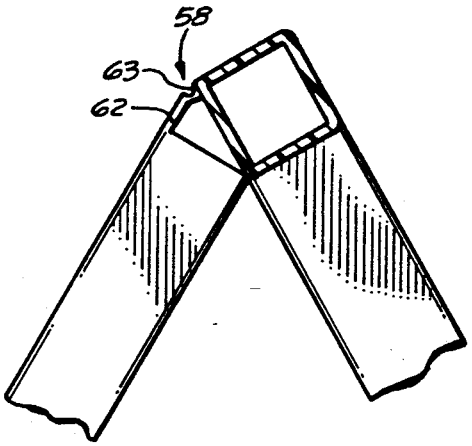
FIG. 12 is a side view of the pivotal hinge shown in FIG. 11.

FIG. 10 illustrates U-shaped frame 52 with tripod leg 59 attached, as it would appear using a single molded piece. In this embodiment, hinge means 58 consists of a thin strip of material 62 which couples tripod leg 59 to cross member 55. Thin strip 62 has a groove 63 formed in it. Groove 63 allows thin strip 62 to have a hinge action. This bending action is shown in FIG. 12 which allows tripod leg 59 to form a third support leg with legs 53 and 54 as shown in FIG. 9.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A golf club carrier comprising:

an inverted U-shaped frame having;

a first leg, a second leg, a cross member coupling said first leg substantially parallel to said second leg at their upper end, a brace parallel to said cross member coupling said first leg to said second leg proximate their lower end, hinge means pivotally attaching a tripod leg to said cross member;

a handle removably coupled to said tripod leg;

a limiting member having one end attached to said tripod leg, and an opposite end attached to said brace; and a plurality of club clips coupled to said first and second legs such that they are arranged in aligned pairs, one clip being carried by each of said first and second legs.

2. A device as claimed in claim 1 wherein said hinge means further comprises a pivotal tee-shaped member coupled to said cross member, and a tee-shaped member coupled to said pivotal tee-shaped member.

3. A device as claimed in claim 2 further comprising coupling means for removably attaching said handle to said tee-shaped member.

4. A device as claimed in claim 3 wherein said coupling means comprises:

a hole defined by said handle, proximate an end;

a hole defined by said tee-shaped pivotal member aligned with the hole of the handle when the handle is attached to the tee-shaped member;

a pin inserted through the aligned holes, securing said handle.

5. A golf club carrier comprising:

an inverted U-shaped frame having;

a first leg, a second leg, a cross member coupling said first leg substantially parallel to said second leg at their upper end, a brace parallel to said cross member coupling said first leg to said second leg proximate their lower end, a pivotal tee-shaped member pivotally coupled to said cross member;

a tee-shaped member coupled to said pivotal tee-shaped member;

a tripod leg attached to said tee-shaped member;

a hole defined by said tee-shaped member;

a handle having a hole proximate an end of said handle, wherein the holes of said handle and said tee-shaped member are aligned when said handle is removably attached to said tee-shaped member by a pin inserted through the aligned holes, securing said handle;

a limiting member having one end attached to said tripod leg, and an opposite end attached to said brace; and a plurality of club clips coupled to said first and second legs such that they are arranged in aligned pairs, one clip being carried by each of said first and second legs.

* * * * *

UNITED STATES PATENT AND TRADEMARK OFFICE

CERTIFICATE OF CORRECTION

PATENT NO. : 5,226,666

DATED : 13 July 1993

INVENTOR(S) : Lucian B. Dinkens

It is certified that error appears in the above-identified patent and that said Letters Patent is hereby corrected as shown below:

In column 2, line 16 insert --would appear-- after "it".

In column 2, line 19 before "FIG" insert --in--.

Signed and Sealed this

Twenty-second Day of February, 1994

*Attest:*

*Attesting Officer*

BRUCE LEHMAN

*Commissioner of Patents and Trademarks*